US005671781A

United States Patent [19]

Palau

[11] Patent Number: 5,671,781

[45] Date of Patent: Sep. 30, 1997

[54] CONCENTRIC DRIVE MECHANISM FOR CONTROLLING RECIPROCAL MOVEMENT OF GRIFFE FRAME BLADES

[75] Inventor: Joseph Palau, Duingt, France

[73] Assignee: Staubli Faverges, Faverges, France

[21] Appl. No.: 678,080

[22] Filed: Jul. 10, 1996

[30] Foreign Application Priority Data

Jul. 18, 1995 [FR] France ..... 95 08910

[51] Int. Cl.[6] ..... D03C 5/06

[52] U.S. Cl. ..... 139/59; 139/65

[58] Field of Search ..... 139/65, 68, 59

[56] References Cited

U.S. PATENT DOCUMENTS

| | | | |
|---|---|---|---|
| 5,092,369 | 3/1992 | Derudder | 139/65 |
| 5,103,873 | 4/1992 | Bassi | 139/65 |
| 5,176,181 | 1/1993 | Bassi | 139/65 X |
| 5,513,676 | 5/1996 | Speich | 139/65 |
| 5,522,435 | 6/1996 | DeRudder | 139/655 |
| 5,538,046 | 7/1996 | Bassi et al. | 139/65 |

FOREIGN PATENT DOCUMENTS 2669650 11/1990 France .

*Primary Examiner*—Andy Falik
*Attorney, Agent, or Firm*—Dowell & Dowell

[57] ABSTRACT

In a jacquard system for forming the shed in a weaving machine, vertical reciprocating blades of griffe frames are controlled by concentric shafts driven by a single cam assembly connected to the input shaft driven by the drive shaft of the weaving machine. Each of the concentric shafts include radially extending levers which are connected to control the reciprocating movement of the blades.

10 Claims, 3 Drawing Sheets

CONCENTRIC DRIVE MECHANISM FOR CONTROLLING RECIPROCAL MOVEMENT OF GRIFFE FRAME BLADES

BACKGROUND OF THE INVENTION

The present invention relates to Jacquard systems for forming the shed in weaving machines and more particularly to the mechanism for vertical actuation of the two series of blades which control of the hooks the system.

FIELD OF INVENTION

It is known that, in practice, that hooks are disposed in parallel rows separated from one another by spaces, in each of which a control blade moves vertically, which blade is most often supported by one of two griffe frames. Each frame is suspended from levers animated by an oscillating movement so as to lower and rise alternately, it being observed that the vertical displacements of the two griffe frames and their blades are effected simultaneously in opposite direction from one another in order to effect opening of the shed for insertion of the weft yarn.

In traditional systems, a single shaft is provided which is connected to the principal shaft of the weaving machine and which extends over the whole length of the frame of the system. Near each of its ends, this shaft, which is animated by a continuous movement of rotation; is equipped with two adjacent systems of cams or eccentrics adapted to convert this continuous rotation into a reciprocating rotation in order to give the levers bearing the griffe frames the desired lowering and rising movements.

Document FR-A-2 669 650 (STAUBLI-VERDOL) clearly illustrates the conventional construction.

The latter presents a certain number of drawbacks. The presence of the mechanisms for converting the continuous movement into reciprocating movement substantially increases the cost of the assembly at the same time as increasing the dimensions of the actuation mechanism and it hinders accessibility to the hooks of the system. Furthermore, these converting mechanisms complicate the general structure of the frame.

It is an object of the present invention to overcome these drawbacks.

SUMMARY OF THE INVENTION

To that end, the present invention relates to a Jacquard system for forming the shed on weaving machines, of the type in which the reciprocating vertical actuation of the two series of horizontal blades is effected from an input shaft animated by a continuous movement of rotation, characterized in that the input shaft transmits by a single cam mechanism a reciprocating movement of rotation to two longitudinal shafts disposed coaxially, one inside the other, and which are provided at each of their ends with two pairs of radially extending levers selectively connected to the blades.

According to a preferred embodiment of the invention, the two coaxial shafts are disposed above the hooks, along the median longitudinal axis of the system, so as to provide access to the hooks.

Of course, the outer shaft is provided with slots arranged to allow passage and angular clearance of the levers secured to the inner shaft, these levers being orientated radially in pairs to define four control balance beams. These beams are connected by small rods to horizontal bars which are guided vertically by means of fixed slideways, and with the aid of rods which pivot on the frame. It is from these bars that the blades for controlling the hooks of the system are suspended, these blades being able to be independent from one another or fixed to two griffe frames.

BRIEF DESCRIPTION OF THE DRAWINGS

The invention will be more readily understood on reading the following description with reference to the accompanying drawings, in which.

DESCRIPTION OF PREFERRED EMBODIMENT

Figure 1:
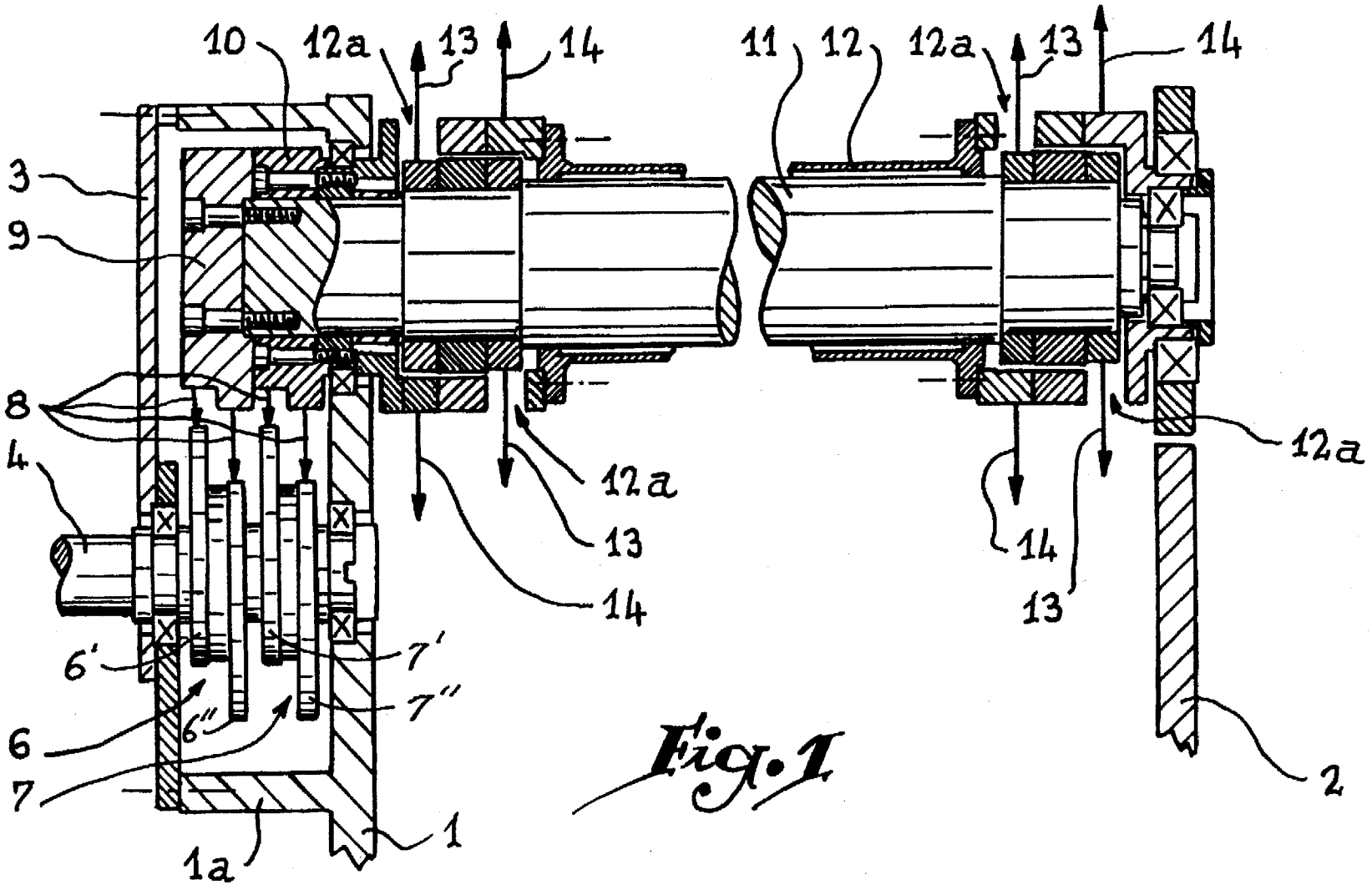
FIG. 1 is a schematic axial section of the actuation mechanism of a Jacquard system according to the invention.
Figure 3:
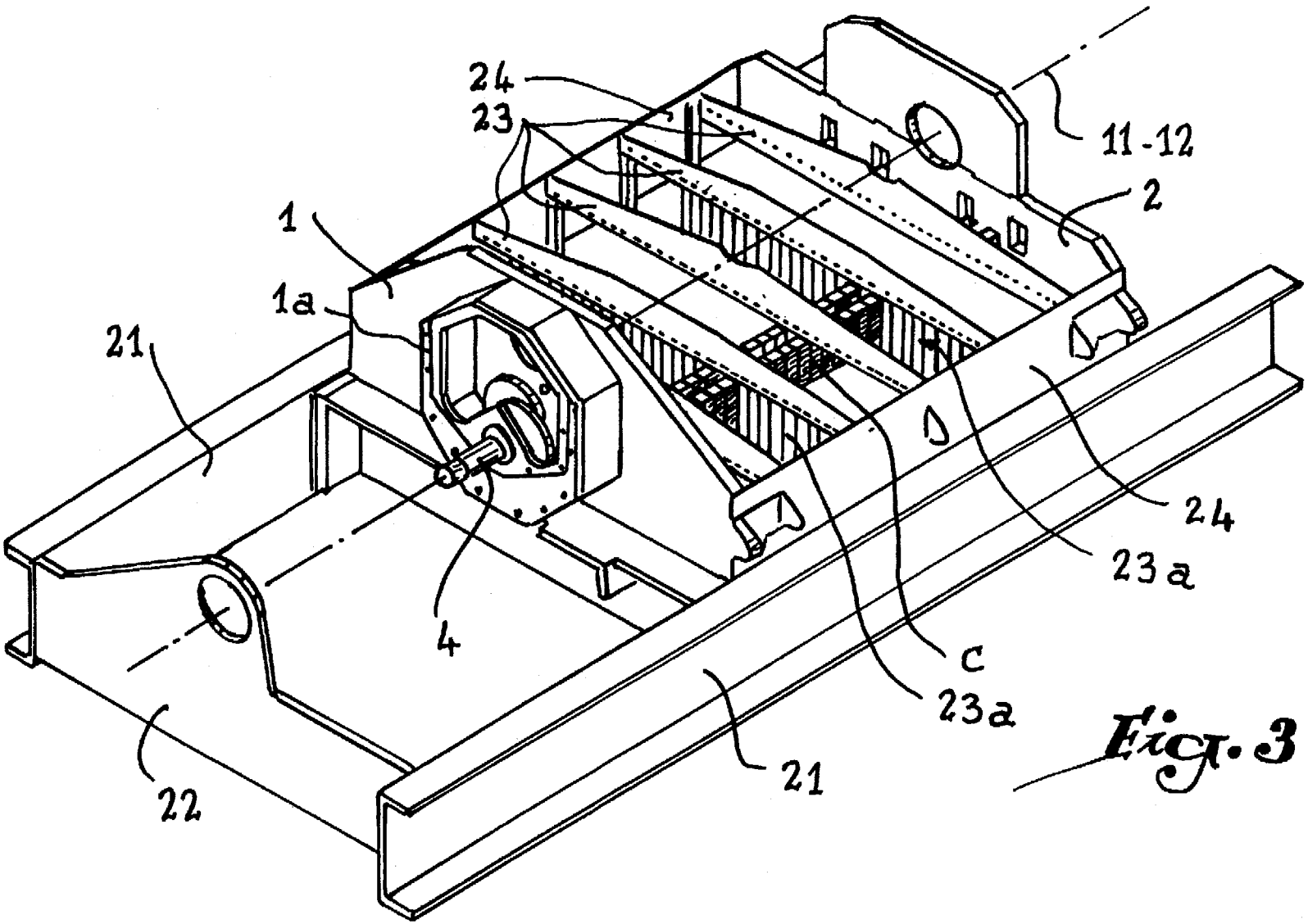
FIG. 3 shows the frame of the system, prior to assembly of the actuation mechanism of FIGS. 1 and 2, and of the hooks.

Referring now to the drawings, and firstly to FIG. 1, references 1 and 2 designate two vertical plates which belong, as will be seen hereinbelow with reference to FIG. 3, to the fixed frame of the system illustrated. That face of plate 1 which is turned outwardly includes a lateral extension 1*a* shaped so as to define a case closed by a cover 3.

Figure 2:
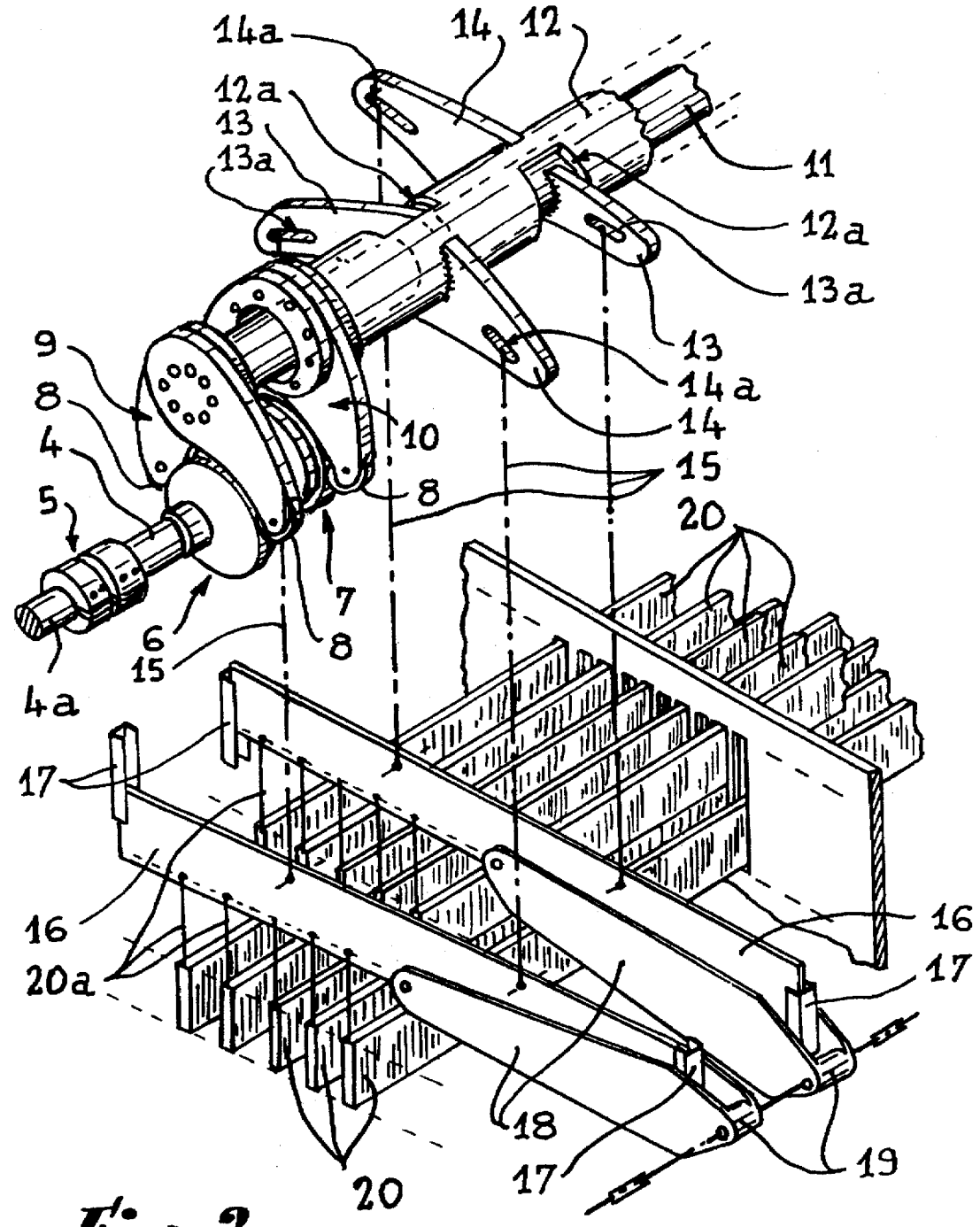
FIG. 2 illustrates, in perspective, the arrangement and positioning of the mechanism according to FIG. 1.

Inside this case 1*a* is mounted an input shaft 4 which extends outwardly opposite the plate 2, to be connected, by a coupling such as the one referenced 5 in FIG. 2, to the end of a shaft 4*a* driven in continuous rotation by the drive shaft of the weaving machine with which the Jacquard system is associated. On that part of this shaft 4 which is disposed inside the case 1*a*–3, there are fitted two conjugate cams 6 and 7; in a manner known per se, each cam 6 or 7 includes two eccentric discs fixed side by side on the same hub, the eccentric parts or lobes 6'/6", 7'/7" forming runways being orientated one opposite the other each cam.

The periphery of each of the discs of the two cams 5 and 6 forms a runway for rollers 8 (shown in the form of arrows in FIG. 1) which are carried by the radial arms, oriented opposite one another and offset axially with respect to one another, of two cam tracking balances 9 and 10. Balance 9 is fixed at the end of a shaft 11 mounted inside an outer shaft 12, of length slightly less than that of shaft 11. Balance 10 is fixed at one end of shaft 12. The two coaxial shafts 11 and 12 are suitably supported in rotation in roller bearings in the plates 1 and 2 and they are oriented along the median longitudinal axis of the frame of the system, in the upper part thereof.

Under these conditions, it will be appreciated that the cam mechanism housed in the case 1*a*–3 ensures conversion of the continuous movement of rotation of the input shaft 4 into an oscillating movement, so that the two coaxial shafts 11 and 12 respect to one another.

In the immediate vicinity of the inner face of each of the two plates 1 and 2, the outer shaft 12 has two slots 12*a* therein, offset axially with respect to each other and orientated opposite each other. Each of these slots 12*a* is traversed by a lever 13 fixed radially to the inner shaft 11. Opposite each lever 13 there is provided a lever 14 radially secured to the outer shaft 12 along the axis of the corresponding lever 13 and it will be understood that each of the pairs of opposite levers 13 and 14 constitutes a sort of balance beam which the two concentric shafts 11 and 12 animate by an oscillating movement.

Each lever 13 and 14 has an arcuate slot 13*a*, 14*a* respectively, for the adjustable fixation of a vertical rod 15

(FIG. 2) whose lower end is coupled to an actuation bar 16. At each plate 1 and 2, two bars 16 are therefore provided, disposed side by side.

The ends of these bars 16 are engaged in slideways 17 rigidly fixed to the frame of the system. In order to improve guiding of its reciprocating vertical movement, there is associated with each bar 16 a horizontal connecting rod 18 which may be bifurcated to embrace both sides of the bar shown. One of the ends of each rod 18 is coupled to the corresponding bar 16, while the opposite end pivots at 19 on the fixed frame.

The two pairs of bars 16 provided at right angles to the plates 1 and 2 are intended to ensure control of two series of blades or horizontal knives 20, with a view to actuating the conventional hooks for actuating the harnesses of the system. In the embodiment shown, it has been assumed that the link between bars 16 and blades 20 is effected with the aid of lines or rods 20*a*; such blades thus being rendered independent of one another; however, it goes without saying that two griffe frames may be employed, in conventional manner.

The general functioning of the system is identical to that of conventional constructions, in that the oscillating movement of the two coaxial shafts 11 and 12 ensures lifting and lowering of the two series of blades 20. The arcuate slots 13*a* and 14*a* of beams 13–14 allow an oblique shed to be obtained, when desired.

The elevated central arrangement of the coaxial shafts 11 and 12 totally opens lateral access to the hooks of the system. The latter comprises only one pair of conjugate cams, disposed in case 1*a*–3 ie. outside the frame, which further improves accessibility to the members of the system.

It should also be observed that this arrangement considerably simplifies the construction of the frame itself. In front of the plate 1 there is provided a transverse cheek 22 arranged for the assembly of the shaft 4*a* connected to the weaving machine. Between the two plates 1 and 2 is inserted a series of spacers 23 which are fixed to two longitudinal panels 24 forming supports for the slideways 17 of the bars 16 and for the pivots 19 of the rods 18. The plates 1 and 2 as well as cheek 22 are secured to a pair of elongated beams 21 as shown in FIG. 3.

At least certain of the spacers 23 have vertical slots 23*a* therein for the passage of the blades 20. The latter are thus adapted to vertically move the hooks (figured as C in FIG. 3) disposed in rows in the housings defined between the plates 1 and 2 and the spacers 23.

Despite its structural simplicity, such a frame is considerably robust, the stresses being carried by the two plates 1 and 2 which may have any desired thickness.

What is claimed is:

1. In a Jacquard system for forming a shed in a weaving machine which includes two sets of blades for controlling the vertical movement of a plurality of rows of hooks, and wherein the system includes a drive shaft, the improvement comprising, an input shaft connected to the drive shaft, a single cam mechanism drivingly connected to said input shaft, a pair of concentric shafts, each having opposite ends, a first means for drivingly connecting an inner of said concentric shafts to said cam mechanism so as to be rotated in a reciprocal motion and a second means for drivingly connecting an outer of said concentric shafts to said cam mechanism so as to be rotated in a reciprocal motion, first pairs of radially extending levers carried by and extending from adjacent said opposite ends of said inner of said concentric shafts and second pairs of radially extending levers carried by and extending from adjacent said opposite ends of said outer of said concentric shafts, and means for connecting each of said first radially extending levers to a first set of blades and means for connecting each of said second radially extending levers to a second set of blades so that said first and second blades are vertically reciprocated as said first and second pairs of radially extending levers are vertically reciprocated by said concentric shafts.

2. The Jacquard system of claim 1 wherein said outer shaft includes slots formed therein through which said first radially extending levers extend from said inner of said concentric shafts.

3. The Jacquard system of claim 2 including first and second cam members, each having generally oppositely oriented lobes, said first means for drivingly connecting including a first cam tracking means engaging said first cam member and said second means for drivingly connecting including a second cam tracking means for engaging said second cam member.

4. The Jacquard system of claim 2 wherein said concentric shafts are mounted within a frame including a pair of vertical plates, and bearing means for mounting said opposite end portions of each of said concentric shafts to said vertical plates.

5. The Jacquard system of claim 4 including a pair of generally parallel and spaced longitudinal panels connected to said vertical plates, and a plurality of spacer elements extending between said longitudinal panels in general parallel spaced relationship with respect to said vertical plates.

6. The Jacquard system of claim 4 wherein each of said means for connecting each of said first radially extending levers and said means for connecting said second radially extending levers includes lateral sets of horizontal bars, and vertical rods for connecting each of said first and second radially extending levers to said horizontal bars.

7. The Jacquard system of claim 6 including a plurality of opposite pairs of slideways in which said horizontal bars are slidingly received, connecting rod members mounted to each of said horizontal bars, said connecting rod members being pivotably mounted relative to said frame.

8. The Jacquard system of claim 5 including a case mounted to one of said vertical plates, and said cam mechanism mounted within said case.

9. The Jacquard system of claim 8 including a pair of beam members mounted to said longitudinal panels.

10. The Jacquard system of claim 1 wherein each of said means for connecting each of said first radially extending levers and said means for connecting said second radially extending levers includes lateral sets of horizontal bars, and vertical rods for connecting each of said first and second radially extending .levers to said horizontal bars.

* * * * *